US006277012B1

(12) United States Patent
Halliley

(10) Patent No.: US 6,277,012 B1
(45) Date of Patent: Aug. 21, 2001

(54) DISK LOCKING DEVICE

(75) Inventor: Alistair G. Halliley, Youngstown, NY (US)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 09/006,872

(22) Filed: Jan. 14, 1998

(51) Int. Cl.[7] ..... B24B 23/02
(52) U.S. Cl. ..... 451/359; 451/508
(58) Field of Search ..... 451/359, 508, 451/509, 510, 360, 353, 911, 449, 511, 538, 521, 523, 524

(56) References Cited

U.S. PATENT DOCUMENTS 604,051 * 5/1898 Keighley ..... 451/511
2,186,402 * 1/1940 Bowen ..... 451/511
2,728,174 * 12/1955 Mastrandrea ..... 451/511

* cited by examiner

*Primary Examiner*—Robert A. Rose
(74) *Attorney, Agent, or Firm*—David Bennett

(57) ABSTRACT

Locking devices for attaching an abrasive disk to a grinder are provided by a backup pad and lock nut combination wherein the mounting aperture of the backup pad is shaped to correspond to the exterior surface of the barrel of the lock nut, which is provided with at least two planar surfaces. This is particularly useful in securing correct alignment where the backup pad is intended to support an abrasive disk having a specific configuration that requires the disk and the backup pad to be aligned in a specific way.

7 Claims, 3 Drawing Sheets

DISK LOCKING DEVICE

BACKGROUND OF THE INVENTION

This relates to a device for releasably securing tools to rotary grinders. The invention is particularly useful for securing tools such as disposable abrasive disks including sanding disks, flap discs, buffing pads and the like to relatively rigid backup pads, disks or plates.

The attachment means is particularly important when the disk and pad are so designed that only a limited range of mutual orientations is permissible. In such situations ensuring that the pad and disk are correctly oriented can be very tedious.

A typical arrangement where this is an important consideration is the abrading system described in PCT/US-96/18927. In a typical device according to this Application, the disk and backup pad are each basically round but with equally spaced chord segments removed from the circumference and vision holes spaced around both the disk and the backup pad. These together provide a clear view of the area being abraded while in use, but only if the holes in the pad and disk are aligned.

The present invention provides a simple and foolproof attachment means that ensures that misalignment is essentially impossible.

DESCRIPTION OF THE INVENTION

The disk locking device of the invention comprises a backup pad with a cooperating lock nut adapted to attach the pad to a rotary grinder having a rotatable drive shaft characterized in that the lock nut has a barrel with an internally threaded circular bore adapted for attachment to the drive shaft of a rotary grinder and an exterior surface comprising at least two essentially planar surface sections and the pad has a central mounting aperture shaped to accomodate the barrel of the lock nut in a close fit, that is a fit that ensures that the barrel of the lock nut fits inside the aperture but is unable to rotate without rotating also the backup pad or damaging the material of the backup pad.

The lock nut component of the invention is preferably provided with a flange at one end of the barrel. The shape of the flange is not critical provided that it is large enough to fulfill its intended function which is to retain an abrasive disk placed on the backup pad upon insertion of the lock nut into the cooperating cavity in the backup pad. The flange portion is not essential and its disk retention function could be supplied by a bolt or bolt plus washer combination adapted to be screwed into the threaded bore of the lock nut.

The device of the invention is particularly effective when the abrasive disk has a mounting aperture that has the same shape as the mounting aperture in the backup pad. In this way it is possible to provide that, when the two mounting apertures, (on the pad and on the disk), are properly aligned, other important features such as vision holes are also aligned. In this way the proper and intended functioning of the abrasive disk is assured.

The exterior surface of the barrel of the lock nut is provided with at least one essentially planar portion and where there is more than one such planar portion these are preferably evenly spaced around the barrel and of equal size. The number of faces is more preferably from three to six and most preferably either three or four. The faces can together provide the complete outer surface of the barrel but more frequently they are connected by arcs of a circle whose center is the axis of the barrel.

The planar face portions are "essentially" planar and this is intended to convey that the faces may have a slight concavity or convexity but the radius of curvature of the surface is at least twice the greatest radial dimension of the barrel. Where the faces on the barrel have a slight convexity, the matching surfaces on the backup pad aperture can be planar or have a slight concavity of the same magnitude, and vice versa. In this way the curvatures are matched and the fit is snug. As a result the stress generated upon rotation is more uniformly distributed. The barrel of the lock nut is preferably slightly tapered to further promote a tight and positive engagement between the barrel of the nut and the backup pad aperture.

The backup pad can be molded so as to provide the desired mounting aperture shapes and dimensions on the opposed surfaces. In some cases however it could be preferred to provide that the backup pad has, on opposed faces, inserts of a rigid material with the desired shapes of the mounting apertures formed in the inserts rather than in the material of the backup pad itself. It these inserts are adapted to be firmly but replaceably located in the backup pad, they could be supplied with a number of configurations such that, to accomodate different abrasive disks with different mounting apertures, it would only be necessary to replace the insert in the backup pad rather than the whole backup pad. The inserts are preferably made out of metal whereas the backup pad is often preferred to have a degree of flexibility, especially in the peripheral potions. For this reason it is usually molded from a high tensile rubber or a plastic resin such as nylon, ABS or a vinyl chloride copolymer.

The purpose of the essentially planar surface portions and the cooperating apertures in the backup pad and disk is to ensure that the disk cannot rotate relative to the backup pad during use. They also have another important effect of great utility in that they permit the direction of rotation to be reversed. This can greatly extend the useful life of an abrasive disk. The essentially planar surface portions provide a positive rotational force to the disk, regardless of the direction of rotation, without the need to rely merely on frictional forces between the disk surface and the flange on the lock nut to avoid slippage.

The lock nut flange is preferably provided with engagement means, such as notches and/or holes, in the peripheral portion of the flange to permit the use of a tool adapted to engage the notches or holes and facilitate rotational movement to tighten or loosen the lock nut.

DRAWINGS

DESCRIPTION OF THE PREFERRED EMBODIMENTS

The invention is further illustrated with reference to the Figures which are intended only to illustrate an embodiment of the invention but not to imply any essential limitation on the scope of the invention.

Figure 1A:
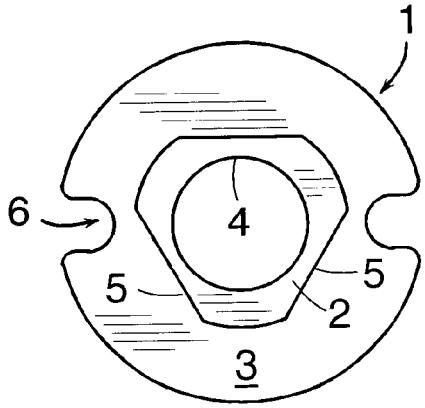
FIG. 1 shows a lock nut in face view and side view.
Figure 1B:
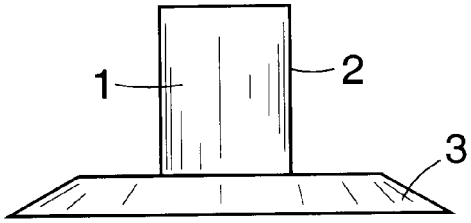
Figure 1C:
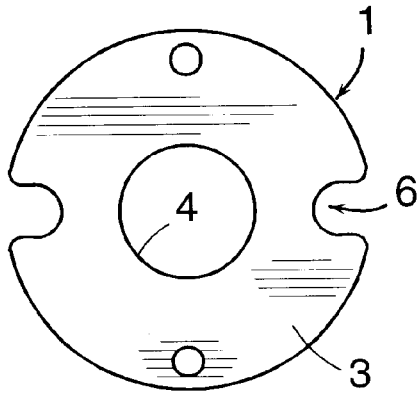

In FIG. 1 three views of a lock nut, 1, are given. In detail, the lock nut is provided with a barrel, 2, having at one end, a flange, 3, and an internal threaded bore, 4. The exterior surface of the barrel is provided with three planar surfaces, 5, at spaced intervals around the barrel giving the barrel a cross-section of an equilateral triangle with highly rounded corners for the exterior surface and a round threaded bore for the interior surface. Two notches, 6, are provided in the periphery of the flange at opposite ends of a diameter of the flange.

Figure 2A:
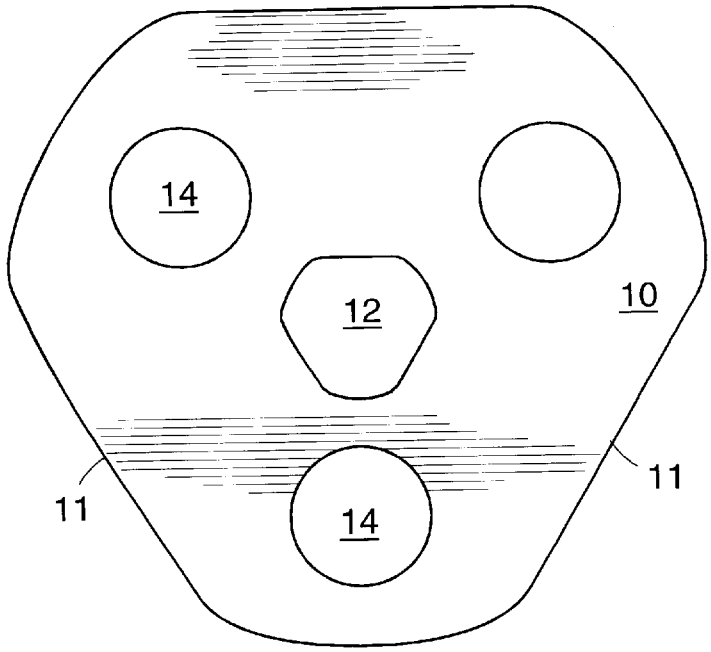
FIG. 2 shows a backup pad, both top and bottom views.
Figure 2B:
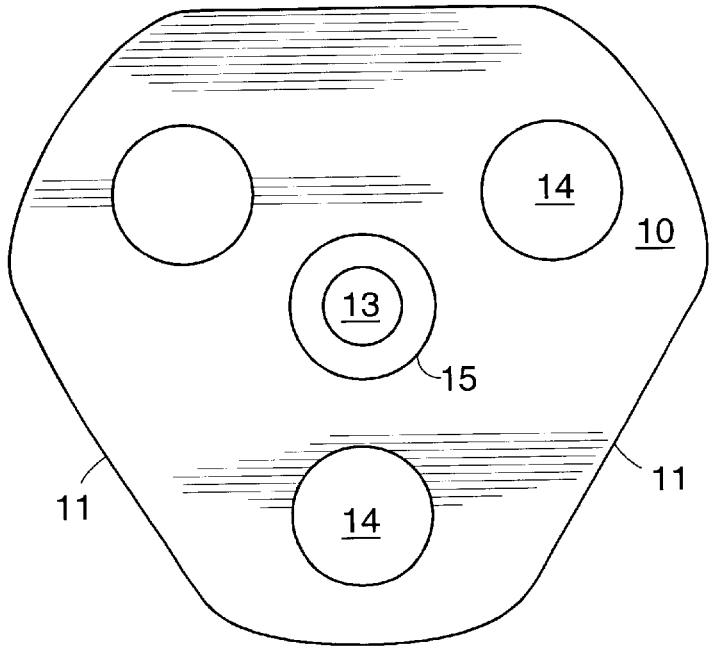

In FIG. 2, top and bottom views of a backup pad, 10, are presented. The pad has a basically circular shape with three peripheral chord segments removed at spaced intervals around the circumference to leave flat edges, 11. The backup pad has an attachment aperture wherein the face that contacts the abrasive disk has a shape, 12, adapted to accomodate the barrel of the lock nut, 1. The mounting aperture on the reverse face, 13, of the backup pad is round, 13, to accomodate the spindle of a rotary grinder. The reverse face of the pad has a raised hub, 15, which accomodates the bore of the lock nut when inserted from the top side. The backup pad is provided with vision holes, 14, spaced around the backup pad.

Figure 3:
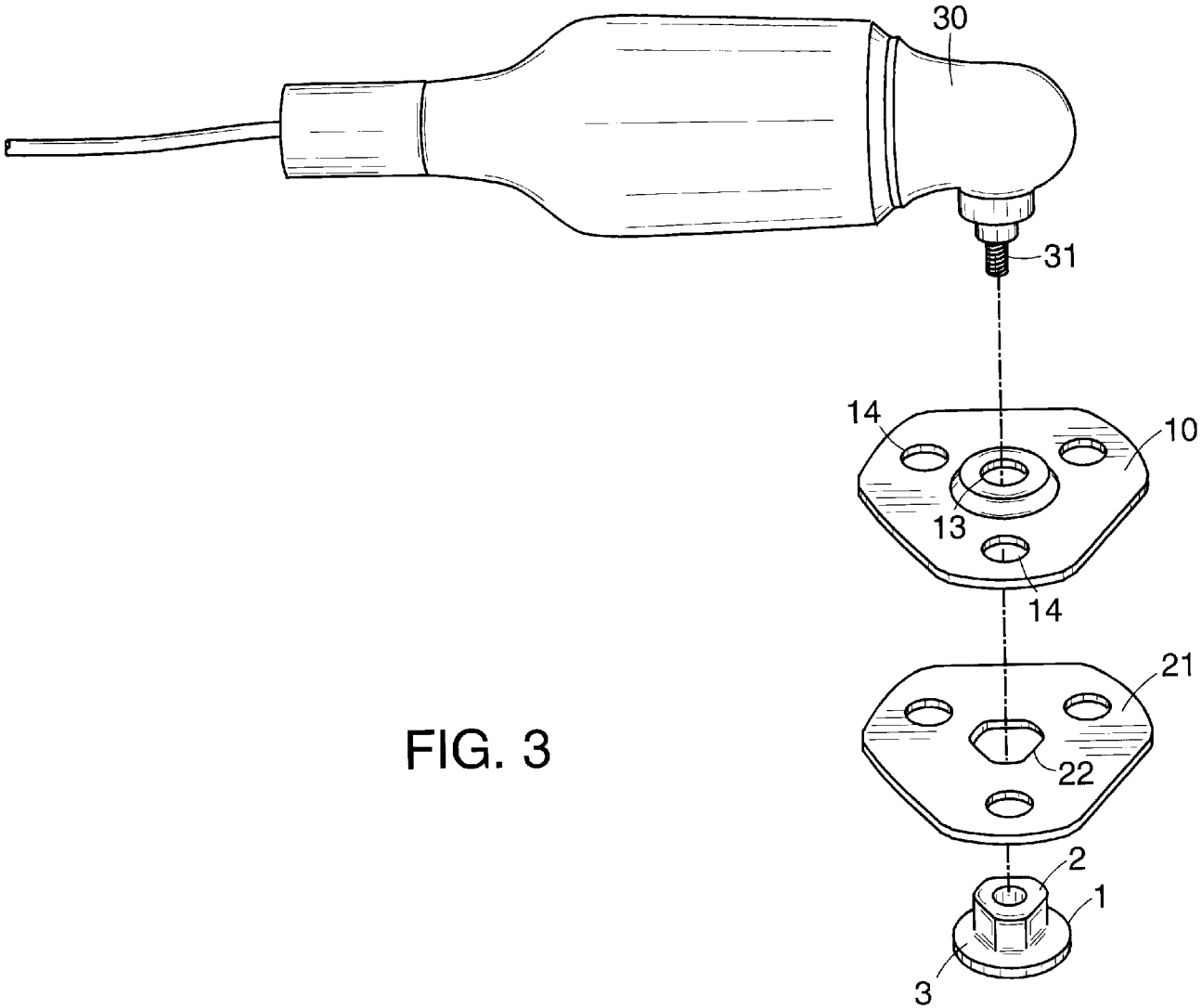
FIG. 3 shows an exploded view of an angle grinder with a backup pad, abrasive disk and lock nut.

FIG. 3 shows an exploded view of a grinder, 30, with an abrasive disk, 21, held on to a backup pad, 10, by means of a lock nut, 1. The abrasive disk has a central mounting aperture, 22, shaped to accomodate the barrel of the lock nut and the lock nut passes through both the disk and the surface of the backup pad that contacts the abrasive disk and screws on to a rotatable threaded spindle, 21, on the grinder which passes through the reverse side of the backup pad. Because the mounting apertures on the abrasive disk and the backup pad are matched, the vision holes and the flat peripheral edge portions on both backup pad and abrasive disk are always perfectly aligned.

The grinder shown is an angle grinder but any form of rotary grinder can be used in the invention provided it is adapted to be attached to a backup pad using a lock nut arrangement.

What is claimed is:

1. A grinding system comprising an abrasive disc and an abrasive disk locking device comprising a backup pad with a cooperating lock nut adapted to attach the pad and the abrasive disc to a rotary grinder having a rotatable drive shaft, characterized in that the lock nut has a barrel with an internally threaded circular bore adapted for attachment to the drive shaft of the rotary grinder and an exterior surface comprising at least one essentially planar surface portion, and both the abrasive disc and the pad have central mounting apertures shaped to accomodate the barrel of the lock nut with a close fit.

2. A grinding system according to claim 1 in which the locking nut has from three to four essentially planar surface sections equally spaced around the circumference of the barrel.

3. A grinding system according to claim 1 in which the lock nut has a flange at one end of the barrel adapted to retain the abrasive disc in contact with the backup pad.

4. A grinding system according to claim 3 in which the flange is provided with engagement means to assist rotation of the lock nut.

5. A grinding system according to claim 1 wherein the backup pad is molded from a resin and the mounting aperture shape is molded into the body of the pad.

6. A grinding system according to claim 1 in which the backup pad and the abrasive disc are provided with aligned viewing apertures at spaced intervals around the pad.

7. A grinding system comprising a rotary grinder, a locking device according to claim 1 comprising a lock nut and a backup pad, and an abrasive disk wherein the abrasive disk and the backup pad have viewing apertures, said abrasive disk being attached to the backup pad by means of the lock nut such that the viewing apertures in both backup pad and abrasive disk are aligned.

* * * * *